US008393759B2

(12) United States Patent
Huang et al.

(10) Patent No.: US 8,393,759 B2
(45) Date of Patent: Mar. 12, 2013

(54) LED LAMP CAPABLE OF ADJUSTING A BEAM SPREAD THEREOF

(75) Inventors: Tsun-Hung Huang, Taichung (TW); Jhon-Ci Liu, Taipei (TW)

(73) Assignee: Shenzhen Jiawei Photovoltaic Lighting Co., Ltd., Shenzhen (CN)

( * ) Notice: Subject to any disclaimer, the term of this patent is extended or adjusted under 35 U.S.C. 154(b) by 220 days.

(21) Appl. No.: 12/975,061

(22) Filed: Dec. 21, 2010

(65) Prior Publication Data

US 2012/0147606 A1 Jun. 14, 2012

(51) Int. Cl.
*F21S 8/00* (2006.01)

(52) U.S. Cl. ..... 362/277; 362/270; 362/319; 362/335

(58) Field of Classification Search ..... 362/187, 362/194–196, 202, 208, 277, 270, 311.01, 362/311.02, 311.14, 319, 335
See application file for complete search history.

(56) References Cited

U.S. PATENT DOCUMENTS 5,031,080 A * 7/1991 Aikens et al. ..... 362/471
5,630,661 A * 5/1997 Fox ..... 362/187
5,816,688 A * 10/1998 Shui-Shang ..... 362/253

* cited by examiner

*Primary Examiner* — Mary Ellen Bowman

(57) ABSTRACT

An LED lamp capable of adjusting a beam spread thereof mainly comprises an adjusting module disposed between a seated body and a cover unit. The adjusting module includes a holder connecting to the seated body, a motivating member traveling within an aperture of the cover unit, an engaging member propping the motivating member against the holder, and a lens disposed on the engaging member. Thereby, rotating the motivating member triggers the engaging member to either move protrudently outward or draw back inward with respect to the cover unit. Accordingly, a beam angle of LED members disposed on a circuit unit of the lamp holder is able to be increasingly condensed or spread, then promoting the luminaire efficiency of the present invention.

1 Claim, 4 Drawing Sheets

LED LAMP CAPABLE OF ADJUSTING A BEAM SPREAD THEREOF

BACKGROUND OF THE INVENTION

1. Field of the Invention

The present invention relates to a design of an LED lamp holder, particularly to an LED lamp capable of adjusting a beam spread thereof.

2. Description of the Related Art

Referring to FIG. 1, a conventional LED lamp whose projecting and condensing module could be freely replaced is disclosed by a Taiwan patent No. M356844. The disclosure comprises a casing unit 11 with an accommodating room 111, a circuit unit 12 disposed within the accommodating room 111, a projecting unit 13 installed in the accommodating room 111, and a detachable cover unit 14 mounted on the casing unit 11. Wherein, the circuit unit 12 includes a holding plate 121 and at least one LED member 122 disposed on the holding plate 121. Moreover, the projecting unit 13, disposed on the holding plate 121, includes at least one projecting member 131 corresponding to the LED member 121. Further, the cover unit 14 includes a lens 141, a gasket 142, a separable inner cover 143 spirally engaged with the casing unit 11, and a removable outer cover 144 spirally engaged with the casing unit 11 for compactly propping against the inner cover 143. Herein, the inner cover 143 has a first aperture 145, and the outer cover 144 has a second aperture 146 corresponding to the first aperture 145. Additionally, the gasket 142 is placed between the casing unit 11 and the inner cover 143 for providing the lens 141 with a tight joint to the projecting unit 13. Thereby, the lens 141 is fixed in the accommodating room 111. In operation, the LED lamps 122 are powered for illuminating. Whereby, the projecting unit 13 condenses and projects the light through the lens 141 of the cover unit 14 for lighting a working surface.

However, in the practical application, each conventional projecting unit offers only a single beam angle. Namely, the illuminant scope provided by the LED member is limited. Thus, although the projecting unit could be detachably disposed on the holding plate of the circuit unit, and although the dispositions of the projecting unit as well as the LED lamps are designed individually replaceable, another projecting unit that renders a different beam angle is needed for changing the beam spread while users want to adjust the lighting scope of the lamp or the beam angle of the light. Accordingly, if users want to freely adjust the beam spread of the LED lamp, they have to prepare various projecting units that offer several different beam angles, and moreover, they have to detach the cover unit so as to suitably replace the desirable projecting unit. Obviously, the replacement of the projecting unit is complicated. In addition, after a long time of repeatingly replacement, the gasket placed between the casing unit and the inner cover may be subject to the elastic fatigue. As a result, the lens may not provide a preferable tight joint with the projecting member anymore, and the luminaire efficiency of the LED lamp might be influenced.

SUMMARY OF THE INVENTION

It is therefore the purpose of this invention to provide an LED lamp capable of adjusting a beam spread thereof that allows a beam angle of the projected light to be freely adjusted so as to suitably concentrate or expand a light scope and obtain the favorable luminous efficacy.

The LED lamp holder capable of adjusting a beam spread thereof in accordance with the present invention comprises a seated body with an accommodating room, a circuit unit as well as a projecting unit respectively disposed within the accommodating room, and a cover unit connected with the seated body. Characterized in that, an adjusting module is disposed between the seated body and the cover unit. The adjusting module has a holder connecting to the seated body, a motivating member penetrating the aperture, an engaging member allowing the motivating member to engage with the holder, and a lens disposed on the engaging member. Wherein, at least three guiding slots are defined around an inner periphery of the holder. At least three open parts are defined on a periphery wall of the motivating member. A plurality of buckling members are extended outward from the peripheral wall for clasping the holder. A plurality of protrudent members, corresponding to the guiding slots and the open parts, are formed around the engaging member, and disposed to protrude beyond the open parts for entering the guiding slots. Rotating the motivating member triggers the protrudent members on the engaging member to slide along the guiding slots. Thereby, a motivation brought about by the motivating member allows the engaging member to move outward or inward with respect to the holder. Whereby, the lens thence reciprocally goes along a protrudent movement or a draw-back movement with respect to the cover unit when the engaging member is triggered. Therefore, the beam angle from the LED lamps of the circuit unit could be gradually adjusted either wider or narrower by means of the motivating member triggering the engaging member. Namely, the beam spread of the light could be increasingly concentrated or expanded so as to achieve the satisfactory luminaire efficiency. Favorably, the present invention simply utilizes the adjusting module to achieve a speedy adjustment in the beam spread of the LED lamps.

Preferably, an optical coupler is disposed on the circuit unit for wirelessly controlling the luminous flux of the LED lamp.

Preferably, one end of each guiding slot is located adjacent to one side of the holder, and the other end of each guiding slot is disposed on the other side of the holder, thereby allowing the guiding slot to be inclined.

DETAILED DESCRIPTION OF THE PREFERRED EMBODIMENTS

Figure 1:
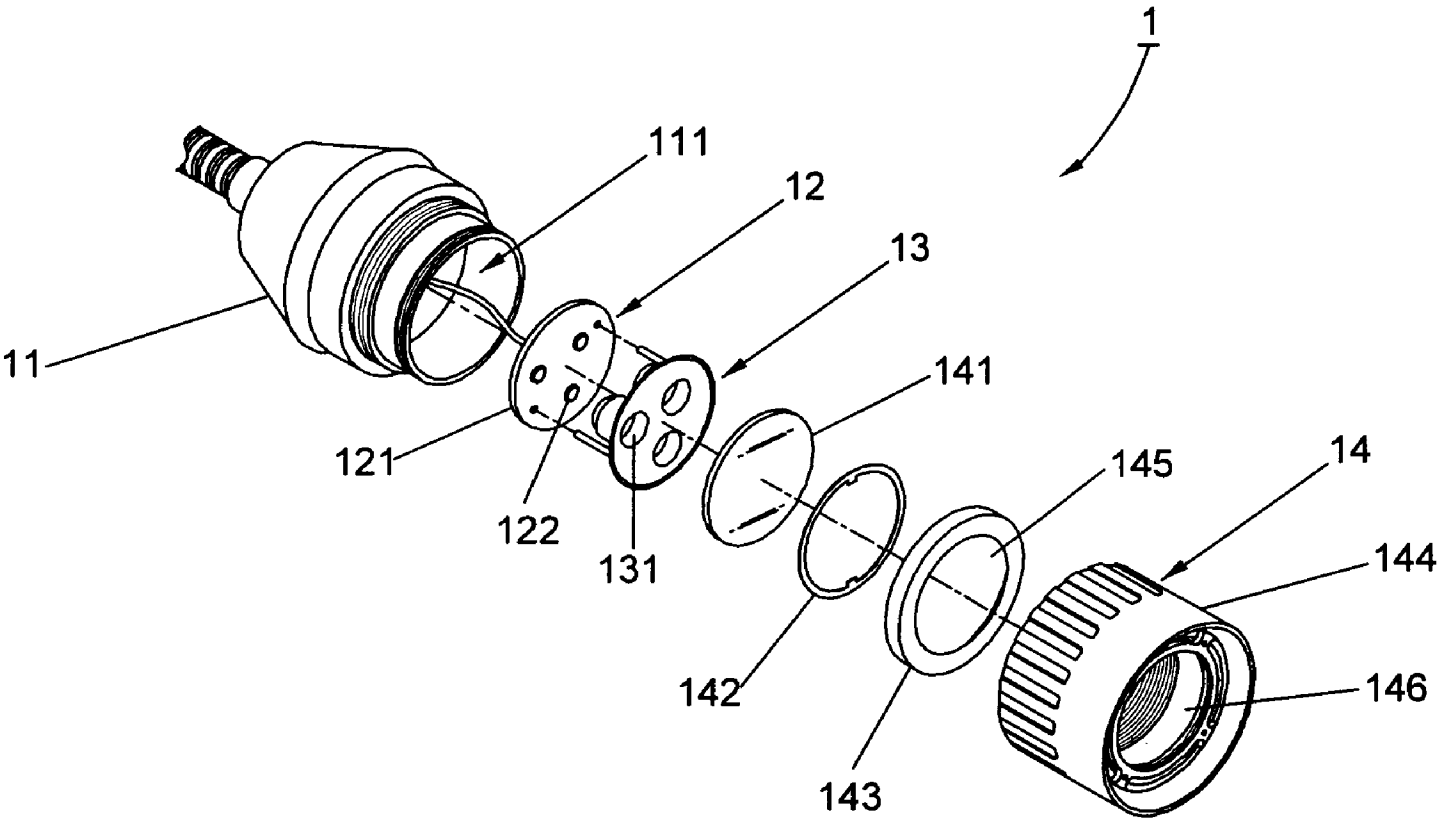
FIG. 1 (PRIOR ART)
FIG. 1 is an exploded view showing a conventional LED lamp whose projecting and condensing module could be freely replaced.

Wherever possible, the same reference numbers are used in the drawings and the description to refer to the same or like parts.

Figure 2:
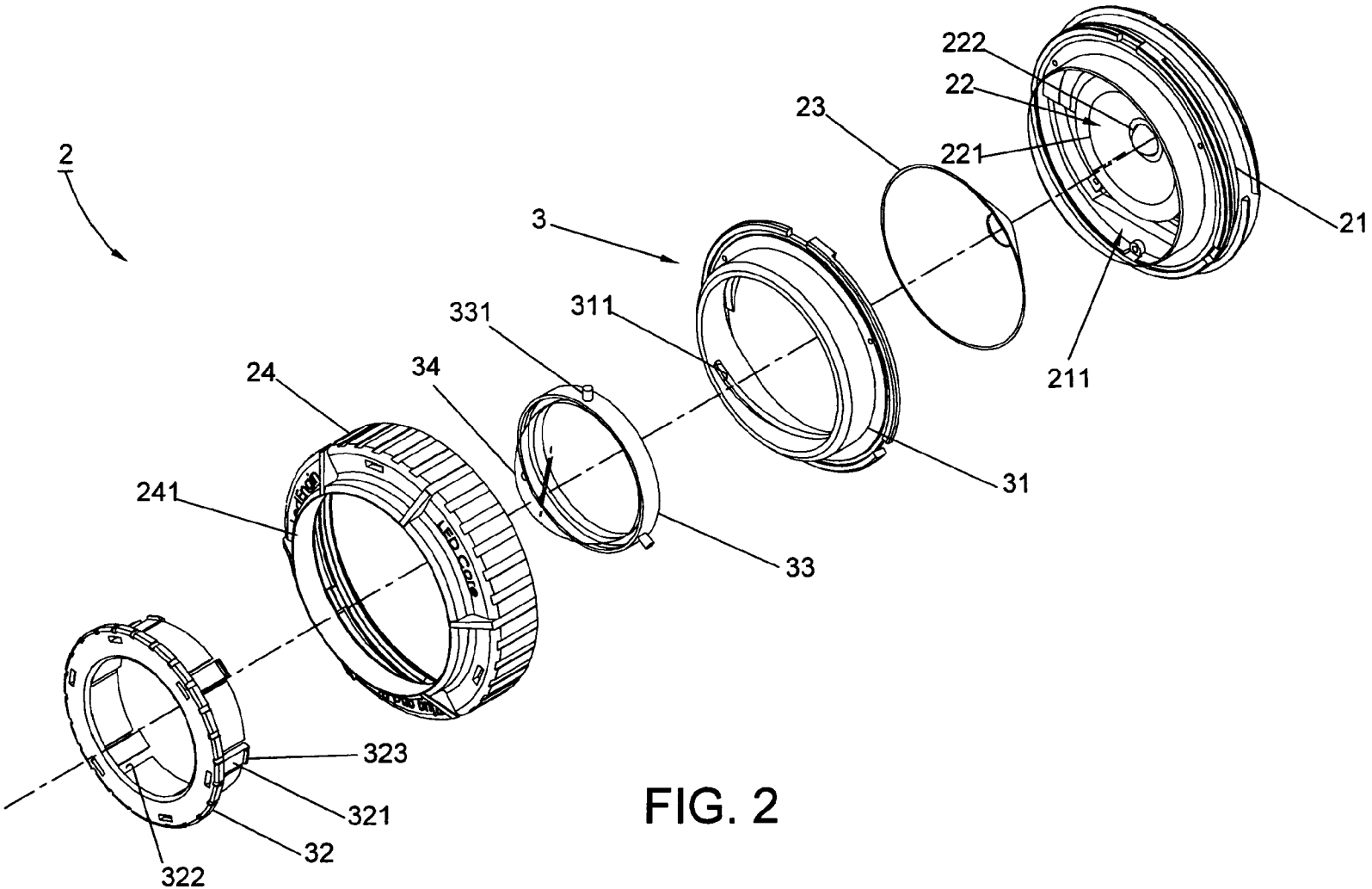
FIG. 2 is an exploded view showing a first preferred embodiment of the present invention.

Referring to FIG. 2, a first preferred embodiment of the present invention is shown. An LED lamp holder 2 for adjusting a beam spread thereof comprises a seated body 21 with an accommodating room 211, a circuit unit 22 as well as a projecting unit 23 respectively disposed within the accommodating room 211, and a cover unit 24 connected with the seated body 21. Wherein, an adjusting module 3 is disposed between the seated body 21 and the cover unit 24. Further, the circuit unit 22 includes a holding plate 221 disposed in the accommodating room 211 and at least one LED member 222 disposed on the holding plate 221. Herein, the projecting unit 23 is mounted on the holding plate 221. An aperture 241 is further defined on the cover unit 24.

Continuingly, the adjusting module 3 has a holder 31 connecting to the seated body 21, a motivating member 32 penetrating the aperture 241, an engaging member 33 allowing the motivating member 32 to engage with the holder 31, and a lens 34 disposed on the engaging member 33. In fact, at least one guiding slot 311 is defined around an inner periphery of the holder 31, and one end of each guiding slot 311 is located adjacent to one side of the holder 31, and the other end of each slot 311 is disposed on the other side of the holder 31, which causes the slot 311 to deflect. At least one open part 322 is defined on a periphery wall 321 of the motivating member 32. A plurality of buckling members 323 extended outward from the peripheral wall 321 are adapted to clasp the holder 31. At least one protrudent member 331, corresponding to the guiding slots 311 and the open parts 322, is formed around the engaging member 33 and disposed to protrude beyond the open parts 322 for entering the guiding slot 311. Rotating the motivating member 32 would trigger the protrudent members 331 on the engaging member 33 to slide along the guiding slots 311. The triggered engaging member 33 thence causes the lens 34 to perform a correspondent protrudent movement or a draw-back movement with respect to the cover unit 24. In this embodiment, there are three guiding slots 311, three open parts 322, and three protrudent members 331 disposed in following depiction.

Figure 3:
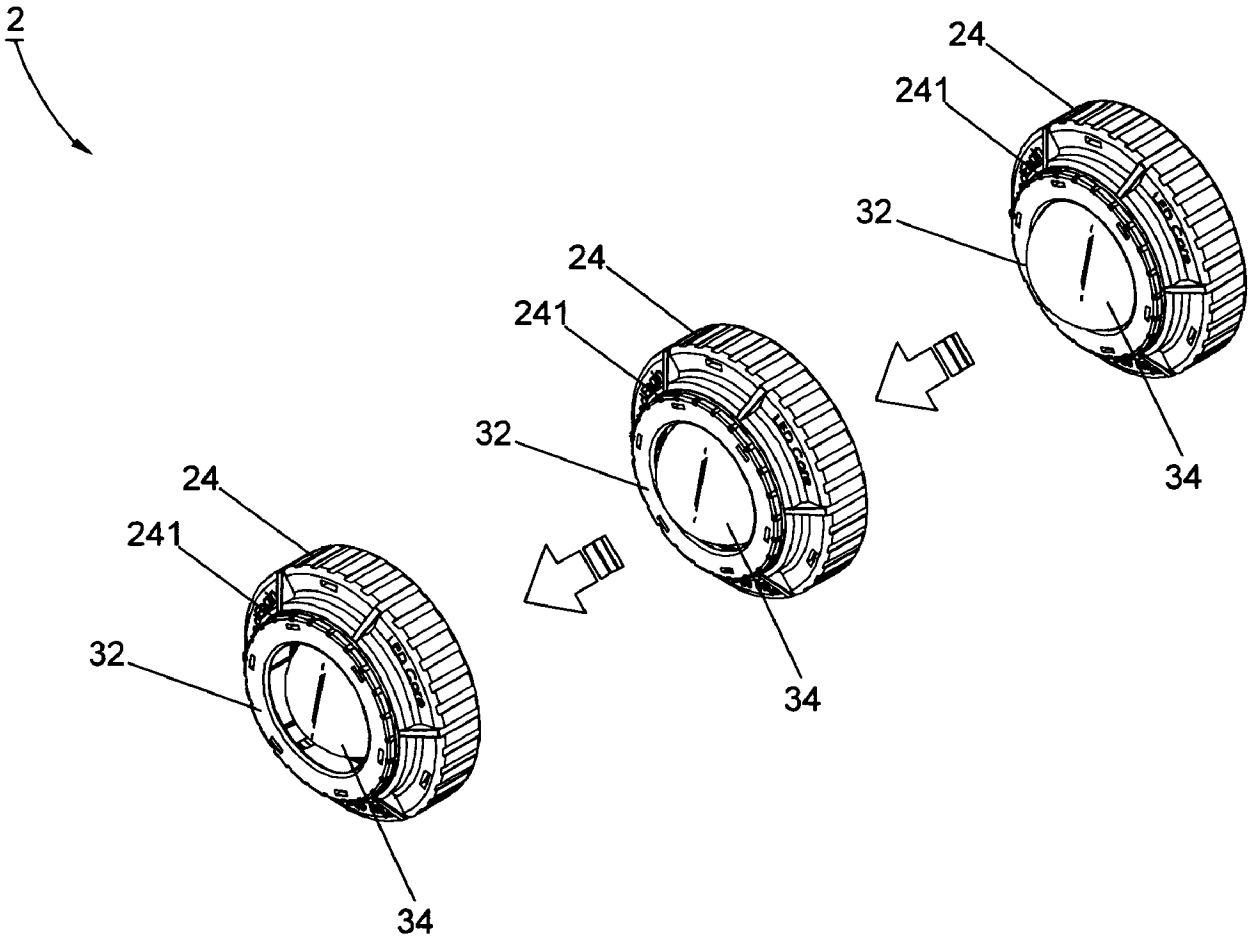
FIG. 3 is a schematic view showing the first preferred embodiment of the present invention in using.

Still referring to FIG. 2, in operation, the LED members 222 on the holding plate 221 are powered to light. The light generated from the LED members 222 goes outward via the projecting unit 23 through the lens 34, so that a working surface that is illuminated by the light are brightened. Herein, if a beam angle of the light is to be adjusted smaller, the adjusting module 3 between the seated body 21 and the cover unit 24 will favorably concentrate the beam from the LED members 222. That is to say, rotating the motivating member 32 between the holder 31 and the cover unit 24 would concurrently trigger the rotation of the engaging member 33. Thereby, the protrudent members 331 on the engaging member 33 would travel along the guiding slots 311 on the holder 31 with respect to a counterclockwise direction. Accordingly, the lens 34 thence gradually draws back into the aperture 241 as clearly shown in FIG. 3, and the light beam radiating from the LED members 22 is gradually restricted by means of the obstruction of the peripheral wall 321 of the motivating member 32. Namely, the beam spread of the LED members 22 is progressively concentrated and focused. Thus, the ideal illumination is obtained, and the satisfactory luminaire efficiency of the LED lamp holder 2 could be achieved.

Oppositely, if the beam angle of the LED members 222 is to be adjusted larger, the motivating member 32 is rotated to concurrently trigger the rotation of the engaging member 33. Thereby, the protrudent members 331 on the engaging member 33 would clockwise travel along the guiding slots 311 on the holder 31. Accordingly, the lens 34 thence gradually protrudes outward the aperture 241. Thereby, the peripheral wall 321 of the motivating member 32 does not obstruct the light beam generated from the LED members 222, and the beam spread of the LED members 222 is thence enlarged. Thus, simply rotating the adjusting module 3 contributes to a convenient change on the beam angle of the light. Favorably, the conventional shortcomings like the complicated adjustment and troublesome detachment between the projecting module and the cover unit are prevented. Thus, an expedient tuning on the luminosity is achieved since the beam spread of the light from the LED holder 2 could be swiftly adjusted.

Figure 4:
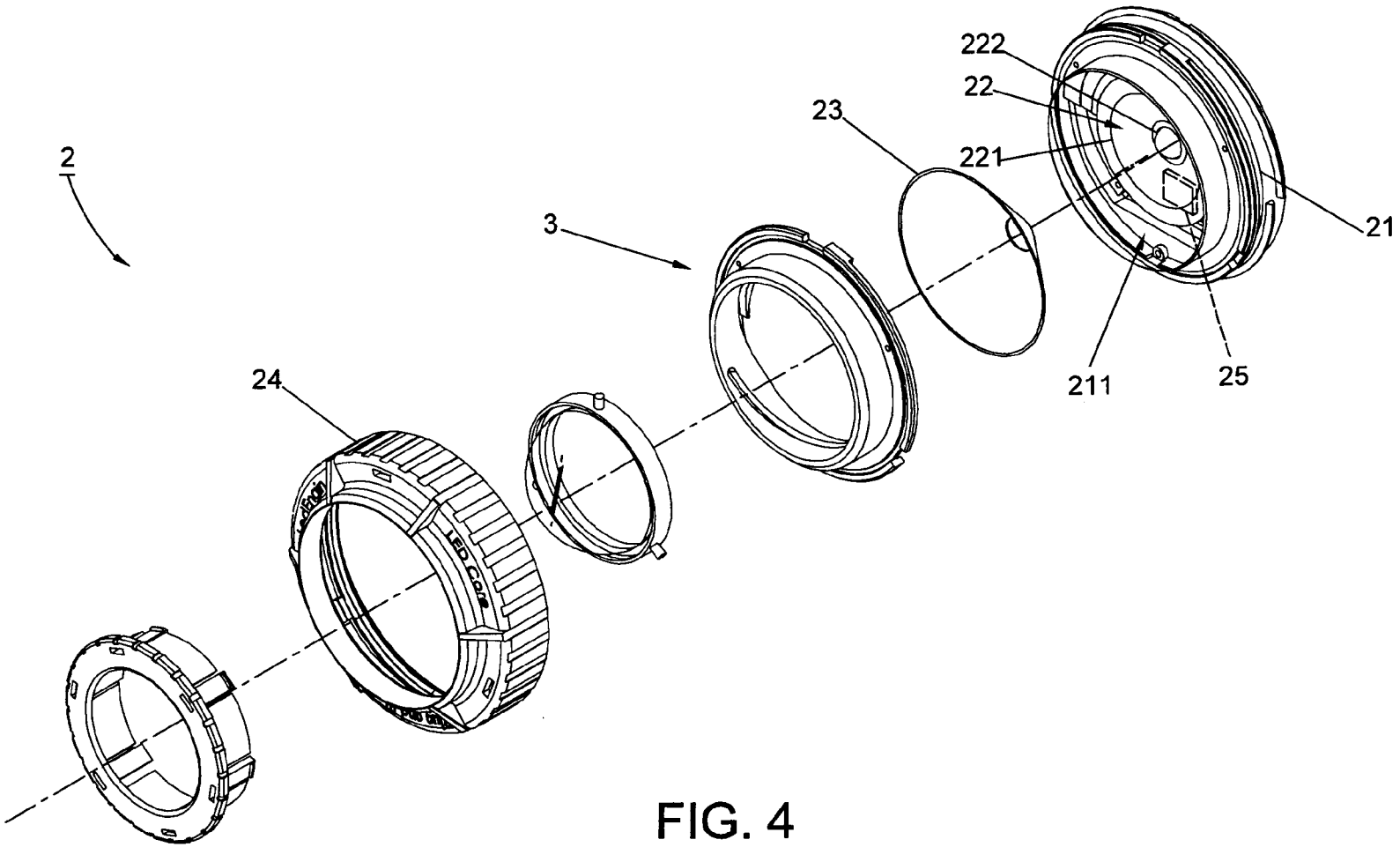
FIG. 4 is a schematic view showing a second preferred embodiment of the present invention.

Referring to FIG. 4, a second preferred embodiment is shown. The LED holder 2 similarly comprises the elements like that of the previous preferred embodiment, such as seated body 21, the circuit unit 22, the projecting unit 23, the cover unit 24, and the adjusting module 3. The like functions and correlations same as that of the previous preferred embodiment are herein omitted. In this embodiment, an optical coupler 25 (shown by a sketch) disposed on the holding plate 221 of the circuit unit 22 is connected to the LED members 222. Further, a controller (not shown) could be adopted for wirelessly controlling the optical coupler 25. Thereby, a signal sent to the controller while adjusting the luminosity from the LED members 222 via the adjusting module 3 allows the optical coupler 25 to wirelessly control the luminous flux of the LED members 222. Accordingly, when the light sent from the LED lamp holder offers a smaller beam angle or a narrower beam spread, the optical coupler 25 preferably controls the output of the current to avoid an overheating working surface where the light beam casts. Thus, the luminaire efficiency of the LED members 222 is promoted.

To sum up, the present invention particularly rotates the adjusting module between the seated body and the cover unit to motivate the engaging member to move either outward or inward with respect to the cover unit. Thereby, the beam angle of the LED members could be freely and gradually adjusted to concentrate or expand the beam spread. As a result, the favorable luminaire efficiency is achieved.

While we have shown and described the embodiment in accordance with the present invention, it should be clear to those skilled in the art that further embodiments may be made without departing from the scope of the present invention.

We claim:

1. An LED lamp capable of adjusting a beam spread thereof comprising a seated body with an accommodating room, a circuit unit as well as a projecting unit respectively disposed within said accommodating room, and a cover unit connected with said seated body; wherein, said circuit unit includes a holding plate disposed in said accommodating room and at least one LED member disposed on said holding plate; an aperture being further defined on said cover unit; characterized in that, an adjusting module is disposed between said seated body and said cover unit; said adjusting module having a holder connecting to said seated body, a motivating member penetrating said aperture, an engaging member allowing said motivating member to engage with said holder, and a lens disposed on said engaging member; wherein, at least one guiding slot is defined around an inner periphery of said holder; at least one open part being defined on a periphery wall of said motivating member; at least one protrudent member, corresponding to said guiding slots and said open parts, being formed around said engaging member and disposed to protrude beyond said open part for entering said guiding slot; a rotation of said motivating member triggering said protrudent members on said engaging member to slide along said guiding slots, whereby said lens is reciprocally moved with respect to said cover unit when said engaging member is triggered, wherein an optical coupler is disposed on said circuit unit for wirelessly controlling the luminous flux of said LED lamp.

* * * * *